US011132976B2

(12) United States Patent
Kim

(10) Patent No.: US 11,132,976 B2
(45) Date of Patent: Sep. 28, 2021

(54) BRIGHTNESS COMPENSATION METHOD AND BRIGHTNESS COMPENSATION DEVICE

(71) Applicants: CHENDGU BOE OPTOELECTRONICS TECHNOLOGY CO., LTD., Sichuan Province (CN); BOE TECHNOLOGY GROUP CO., LTD., Beijing (CN)

(72) Inventor: Tairong Kim, Beijing (CN)

(73) Assignees: CHENGDU BOE OPTOELECTRONICS TECHNOLOGY CO., LTD., Sichuan (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/650,402

(22) PCT Filed: May 13, 2019

(86) PCT No.: PCT/CN2019/086616
§ 371 (c)(1),
(2) Date: Mar. 25, 2020

(87) PCT Pub. No.: WO2019/218962
PCT Pub. Date: Nov. 21, 2019

(65) Prior Publication Data

US 2020/0294469 A1 Sep. 17, 2020

(30) Foreign Application Priority Data

May 14, 2018 (CN) ..... 201810455304.5

(51) Int. Cl.
*G09G 5/10* (2006.01)

(52) U.S. Cl.
CPC ..... *G09G 5/10* (2013.01)

(58) Field of Classification Search
CPC ..... G09G 5/10; G09G 2340/14; G09G 3/20; G09G 5/00; G09G 2320/028
See application file for complete search history.

(56) References Cited

U.S. PATENT DOCUMENTS 9,754,522 B2 * 9/2017 Park ..... G09G 3/20
10,147,391 B2 12/2018 Jun et al.
(Continued)

FOREIGN PATENT DOCUMENTS

CN 104464633 3/2015
CN 104932144 9/2015
(Continued)

OTHER PUBLICATIONS

Office action from Chinese Application No. 201810455304.5 dated Jul. 25, 2019.
(Continued)

*Primary Examiner* — Rodney Amadiz
(74) *Attorney, Agent, or Firm* — Calfee, Halter & Griswold LLP

(57) ABSTRACT

Disclosed is a brightness compensation method and a brightness compensation device. The brightness compensation method includes: acquiring original brightness data of pixels in the curved area before forming the curved area; acquiring current brightness data of the pixels in the curved area after forming the curved area; determining a brightness compensation coefficient of the pixels in the curved area according to the original brightness data and the current brightness data; and compensating the original brightness data based on the brightness compensation coefficient to obtain target brightness data of the pixels in the curved area.

8 Claims, 4 Drawing Sheets

(56) References Cited

U.S. PATENT DOCUMENTS

| | | | | |
|---|---|---|---|---|
| 2013/0321740 | A1 | 12/2013 | An et al. | |
| 2014/0306985 | A1* | 10/2014 | Jeong | G09G 5/06 345/601 |
| 2016/0117994 | A1* | 4/2016 | Lee | G09G 3/36 345/694 |
| 2017/0206859 | A1 | 7/2017 | Jun | |
| 2018/0122284 | A1 | 5/2018 | Zhang | |
| 2019/0152831 | A1* | 5/2019 | An | B32B 17/10889 |
| 2020/0066219 | A1* | 2/2020 | Hsu | G09G 3/006 |
| 2020/0193898 | A1* | 6/2020 | Wang | G06F 3/147 |

FOREIGN PATENT DOCUMENTS

| | | |
|---|---|---|
| CN | 104965329 | 10/2015 |
| CN | 105244007 | 1/2016 |
| CN | 105590605 | 5/2016 |
| CN | 205705617 | 11/2016 |
| CN | 206212505 | 5/2017 |
| CN | 107221290 | 9/2017 |
| CN | 206877302 | 1/2018 |
| CN | 107731185 | 2/2018 |
| CN | 107749284 | 3/2018 |
| CN | 107808598 | 3/2018 |
| CN | 107978230 | 5/2018 |
| CN | 108262646 | 7/2018 |
| CN | 108648722 | 10/2018 |

OTHER PUBLICATIONS

Office action from Chinese Application No. 201810455304.5 dated Mar. 11, 2020.

Office action from Chinese Application No. 201810455304.5 dated Jun. 5, 2020.

* cited by examiner

BRIGHTNESS COMPENSATION METHOD AND BRIGHTNESS COMPENSATION DEVICE

RELATED APPLICATIONS

The present application is a 35 U.S.C. 371 national stage application of PCT International Application No. PCT/CN2019/086616, filed on May 13, 2019, which claims the benefit of Chinese Patent Application No. 201810455304.5, filed on May 14, 2018, the entire disclosures of which are incorporated herein by reference.

TECHNICAL FIELD

The present disclosure relates to the field of display technology, and in particular, to a brightness compensation method and a brightness compensation device.

BACKGROUND

In the process of manufacturing a display panel, due to factors such as process level and purity of raw materials, display unevenness of the display panel is easily caused, which can also be referred to as the mura phenomenon. In order to reduce the mura phenomenon, demura technology is used to compensate the display data of the pixels in the display panel.

However, for curved display panels, due to the presence of curved areas, the light emitting directions of the pixels are different from each other. When a camera is used to take pictures from the front of the curved display panel, the brightness of pixels in the curved area is lower than the brightness of pixels in the flat area. When performing demura compensation based on the brightness data acquired by the camera, it is apt to cause excessive compensation for the curved area.

SUMMARY

Exemplary embodiments provide a brightness compensation method for a curved display panel having a curved area. The brightness compensation method includes: acquiring original brightness data of pixels in the curved area before forming the curved area; acquiring current brightness data of the pixels in the curved area after forming the curved area; determining a brightness compensation coefficient of the pixels in the curved area based on the original brightness data and the current brightness data; and compensating the original brightness data based on the brightness compensation coefficient to obtain target brightness data of the pixels in the curved area.

In some exemplary embodiments, the original brightness data is a first average brightness of a column of pixels in the curved area before forming the curved area; the current brightness data is a second average brightness of the column of pixels in the curved area after forming the curved area. The curved display panel is obtained by attaching a cover plate to a flat display panel and performing a bending process on the flat display panel.

In some exemplary embodiments, the step of determining the brightness compensation coefficient of the pixels in the curved area based on the original brightness data and the current brightness data includes: multiplying a ratio of the first average brightness to the second average brightness by a transmittance of the cover plate corresponding to the column of pixels, thereby obtaining the brightness compensation coefficient of the column of pixels.

In some exemplary embodiments, prior to acquiring the original brightness data of the pixels in the curved area before forming the curved area, the method further includes performing demura compensation on pixels in the flat display panel.

In some exemplary embodiments, the method further includes: storing the brightness compensation coefficient in a driving chip of the curved display panel.

Exemplary embodiments provide a brightness compensation device for a curved display panel having a curved area. The brightness compensation device includes: an acquisition circuit configured to acquire original brightness data of pixels in the curved area before forming the curved area, and acquire current brightness data of the pixels in the curved area after forming the curved area; a determining circuit configured to determine a brightness compensation coefficient of the pixels in the curved area based on the original brightness data and the current brightness data; and a compensation circuit configured to compensate the original brightness data based on the brightness compensation coefficient to obtain target brightness data of the pixels in the curved area.

In some exemplary embodiments, the acquisition circuit includes: a first average brightness acquiring sub-circuit configured to acquire a first average brightness of a column of pixels in the curved area before forming the curved area; and a second average brightness acquiring sub-circuit configured to acquire a second average brightness of the column of pixels in the curved area after forming the curved area. The curved display panel is obtained by attaching a cover plate to a flat display panel and performing a bending process on the flat display panel.

In some exemplary embodiments, the determining circuit includes: a brightness compensation coefficient calculation unit configured to multiply a ratio of the first average brightness to the second average brightness by a transmittance of the cover plate corresponding to the column of pixels, thereby obtaining the brightness compensation coefficient of the column of pixels.

In some exemplary embodiments, the brightness compensation device further includes a demura compensation circuit configured to perform demura compensation on pixels in the flat display panel.

In some exemplary embodiments, the brightness compensation device further includes a driving chip configured to drive the curved display panel and store the brightness compensation coefficient.

DETAILED DESCRIPTION OF THE DISCLOSURE

In order to make the foregoing objectives, features, and advantages of the present disclosure more comprehensible, exemplary embodiments are described in further detail below with reference to the accompanying drawings and specific embodiments.

Figure 1:
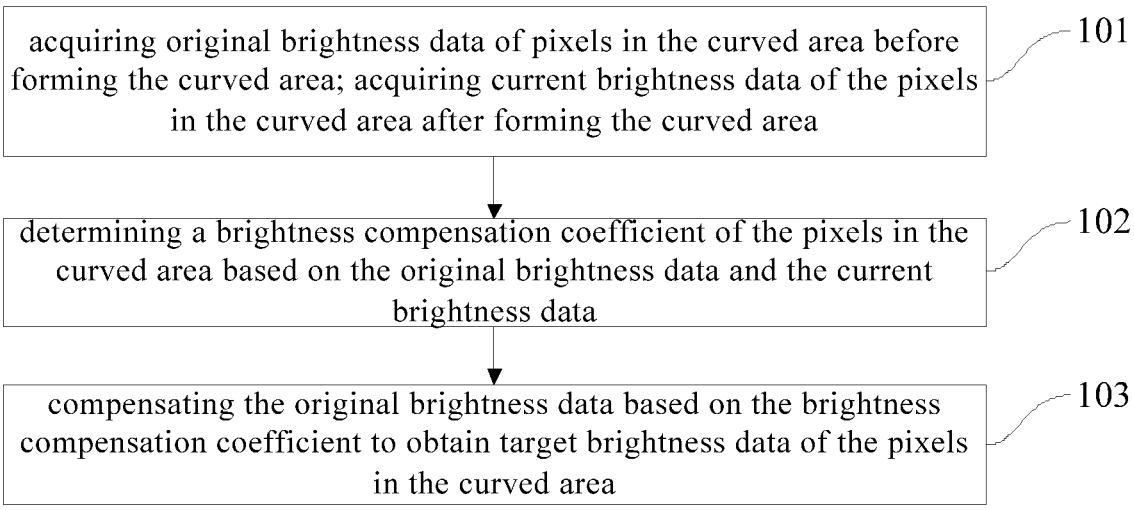
FIG. 1 shows a flowchart of a brightness compensation method according to an exemplary embodiment.

Referring to FIG. 1, a flowchart of a brightness compensation method according to an exemplary embodiment is shown. The brightness compensation method is applied to a curved display panel having a curved area. The brightness compensation method may include the following steps.

Step 101, acquiring original brightness data of pixels in the curved area before forming the curved area; acquiring current brightness data of the pixels in the curved area after forming the curved area.

Step 102, determining a brightness compensation coefficient of the pixels in the curved area based on the original brightness data and the current brightness data.

Step 103, compensating the original brightness data based on the brightness compensation coefficient to obtain target brightness data of the pixels in the curved area.

In some exemplary embodiments of the present disclosure, the curved display panel includes a flat area and a curved area. The curved area may include a first curved area and a second curved area located on both sides of the flat area, or may include only the first curved area or the second curved area located on one side of the flat area.

Based on the brightness of the pixels of the curved display panel before forming the curved area (i.e., the original brightness data) and the brightness of the pixels after forming the curved area (i.e., the current brightness data), the brightness compensation coefficient c(x) of the pixels in the curved area of the curved display panel is determined.

After calculating the brightness compensation coefficient c(x) of the pixels in the curved area, the brightness compensation coefficient c(x) may be stored in an external compensation device, or it may be stored in a driver IC (driver chip) of the curved display panel.

Figure 2:
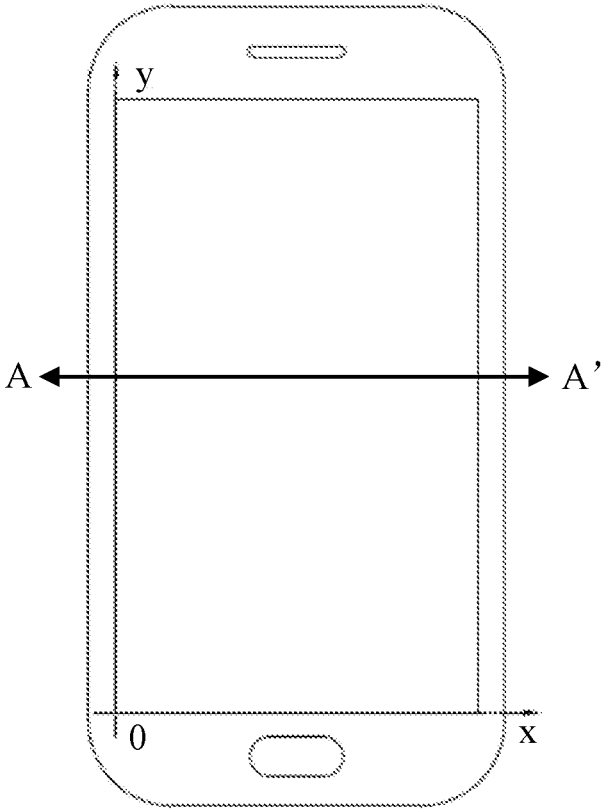
FIG. 2 is a schematic structural diagram of a curved display panel according to an exemplary embodiment.
Figure 3:
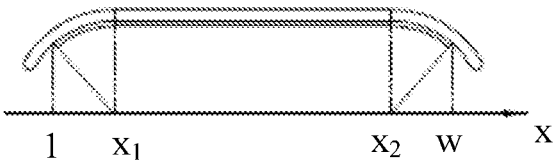
FIG. 3 is a cross-sectional view taken along line A-A' in the curved display panel shown in FIG. 2.

A schematic structural diagram of a curved display panel according to an exemplary embodiment is shown in FIG. 2, and FIG. 3 is a cross-sectional view taken along line A-A' in the curved display panel shown in FIG. 2.

As shown in FIG. 2, the lower left corner of the effective display area of the curved display panel is positioned as the coordinate origin 0, the short side is the x-axis, and the long side is the y-axis. The cross-sectional view taken along line A-A' parallel to the x-axis is shown in FIG. 3. The pixels from the first column to the $x_1$-th column are located in the first curved area of the curved display panel, and the pixels from the $x_2$-th column to the w-th pixel are located in the second curved area of the curved display panel. The pixels from the $x_1$-th column to the $x_2$-th column are located in the flat area of the curved display panel.

With respect to the pixels in the flat area, the main light emitting directions of the pixels in the first curved area and the pixels in the second curved area are not in the front direction. When a camera is used to take pictures from the front of the curved display panel, the brightness of the pixels in the first curved area and the second curved area is lower than the brightness of the pixels in the flat area, thus the brightness of the first curved area and the second curved area is attenuated when the picture is taken. Therefore, it is necessary to compensate the brightness (i.e., the current brightness data) of the attenuation area (i.e., the first curved area and the second curved area), and obtain the brightness compensation coefficient $c_1(x)$ of the pixels in the first curved area and the brightness compensation coefficient $c_2(x)$ of the pixels in the second curved area.

It should be noted that, in the curved display panel shown in FIG. 2 and FIG. 3, the curved area includes a first curved area and a second curved area. It can be understood that, when the curved area of the curved display panel includes only the first curved area, the pixels from the first column to the $x_1$-th column are located in the first curved area of the curved display panel, and the pixels from the $x_1$-th column to the w-th column are located in the flat area, only the brightness compensation coefficient $c_1(x)$ of the pixels in the first curved area is obtained. When the curved area of the curved display panel includes only the second curved area, the pixels from the $x_2$-th column to the w-th column are located in the second curved area of the curved display panel, and the pixels from the first column to the $x_2$-th column are located in the flat area of the curved display panel, only the brightness compensation coefficient $c_2(x)$ of the pixels in the second curved area is obtained.

When the curved area of the curved display panel includes a first curved area and a second curved area, the first curved area and the second curved area may be symmetrical with respect to the center of the curved display panel, that is, the curved shape of the first curved area is same to the curved shape of the second curved area. Of course, the first curved area and the second curved area may not be symmetrical to each other, that is, the curved shapes of the first curved area and the second curved area are different, which is not limited in the exemplary embodiments.

In some exemplary embodiments, a camera is used to take a picture from the front of the curved display panel, and the original brightness data L(x, y) of each pixel in the curved area is acquired.

When the curved area of the curved display panel includes a first curved area and a second curved area, the original brightness data $L_1(x, y)$ of each pixel in the first curved area and the original brightness data $L_2(x, y)$ of each pixel in the second curved area are acquired separately. When the curved display panel has only the first curved area, the original brightness data $L_1(x, y)$ of each pixel in the first curved area is acquired. When the curved display panel has only the second curved area, the original brightness data $L_2(x, y)$ of each pixel in the second curved area is acquired.

In exemplary embodiments, the original brightness data L(x, y) of each pixel in the curved area is compensated based on the brightness compensation coefficient c(x) of the pixels in the curved area, thereby obtaining the target brightness data Lc(x, y) of the pixels in the curved area, where $Lc(x, y)=c(x)\times L(x, y)$.

If the brightness compensation coefficient c(x) is stored in an external compensation device, the original brightness data L(x, y) of each pixel in the surface area acquired by the camera is input to the compensation device, and the target brightness data Lc(x, y) of the pixels in the curved area is calculated in the compensation device. If the brightness compensation coefficient c(x) is stored in the driver IC of the curved display panel, the demura compensation parameter is directly calculated based on the original brightness data L(x, y) of each pixel in the curved area acquired by the camera. In the demura function in the driver IC, the driver IC corrects the demura compensation parameter based on the brightness compensation coefficient c(x), and corrects the demura compensation parameter to the demura compensation parameter corresponding to the target brightness data Lc(x, y).

When the curved area includes the first curved area and the second curved area, the original brightness data $L_1(x, y)$ of the pixels in the first curved area are compensated based on the brightness compensation coefficient $c_1(x)$ of the pixels in the first curved area, thereby obtaining the target brightness data $Lc_1(x, y)$ of the pixels in the first curved area, and the original brightness data $L_2(x, y)$ of the pixels in the second curved area are compensated based on the brightness compensation coefficient $c_1(x)$ of the pixels in the second curved area, thereby obtaining the target brightness data $Lc_2(x, y)$ of the pixels in the second curved area, where $Lc_1(x, y)=c_1(x)\times L_1(x, y)$, $Lc_2(x, y)=c_2(x)\times L_2(x, y)$.

The brightness compensation coefficient is used to correct the brightness attenuation of the first curved area and the second curved area after forming the curved surface area, and the original luminance data of the pixels in the first curved area and the second curved area are compensated to the target brightness data in the front observation state.

When the curved area includes the first curved area, the original brightness data $L_1(x, y)$ of the pixels in the first curved area are compensated based on the brightness compensation coefficient $c_1(x)$ of the pixels in the first curved area, thereby obtaining the target brightness data $Lc_1(x, y)$ of the pixels in the first curved area. When the curved area includes the second curved area, the original brightness data $L_2(x, y)$ of the pixels in the second curved area are compensated based on the brightness compensation coefficient $c_2(x)$ of the pixels in the second curved area, thereby obtaining the target brightness data $Lc_2(x, y)$ of the pixels in the second curved area.

For the brightness compensation coefficient $c(x)$ of the pixels in the curved area, each pixel may correspond to a brightness compensation coefficient, and the original brightness data of each pixel is multiplied by the corresponding brightness compensation coefficient to obtain the target brightness data. It is also feasible that each column of pixels corresponds to a compensation coefficient; for the pixels in the same column, the original brightness data of each pixel is multiplied by the same brightness compensation coefficient to obtain the target brightness data of each pixel.

It should be noted that, when step 101 is performed, original brightness data of pixels in the flat area of the curved display panel may also be acquired. Since there is no change in the light emitting direction of the pixels in the flat area, there is no need to compensate the pixels in the flat area, that is, the brightness compensation coefficient of the pixels in the flat area is 1. After the original brightness data of the pixels in the curved area are compensated to the target brightness data, demura compensation is performed on the pixels in the flat area and the curved area based on the original brightness data of the pixels in the flat area and the target brightness data of the pixels in the curved area.

In some exemplary embodiment, the brightness compensation coefficient of the pixels in the curved area is determined based on the brightness of the pixels in the curved display panel before forming the curved area and the brightness of the pixels after forming the curved area. The original brightness data of the pixels in the curved area is acquired. The target brightness data of the pixels in the curved area is obtained by compensating the original brightness data based on the brightness compensation coefficient. The brightness compensation coefficient is used to correct the brightness attenuation of the curved area after forming the curved area. The original brightness data of the pixels in the curved area are compensated to the target brightness data in the front observation state, which reduces the excessive compensation for the curved area in the demura compensation operation.

Figure 4:
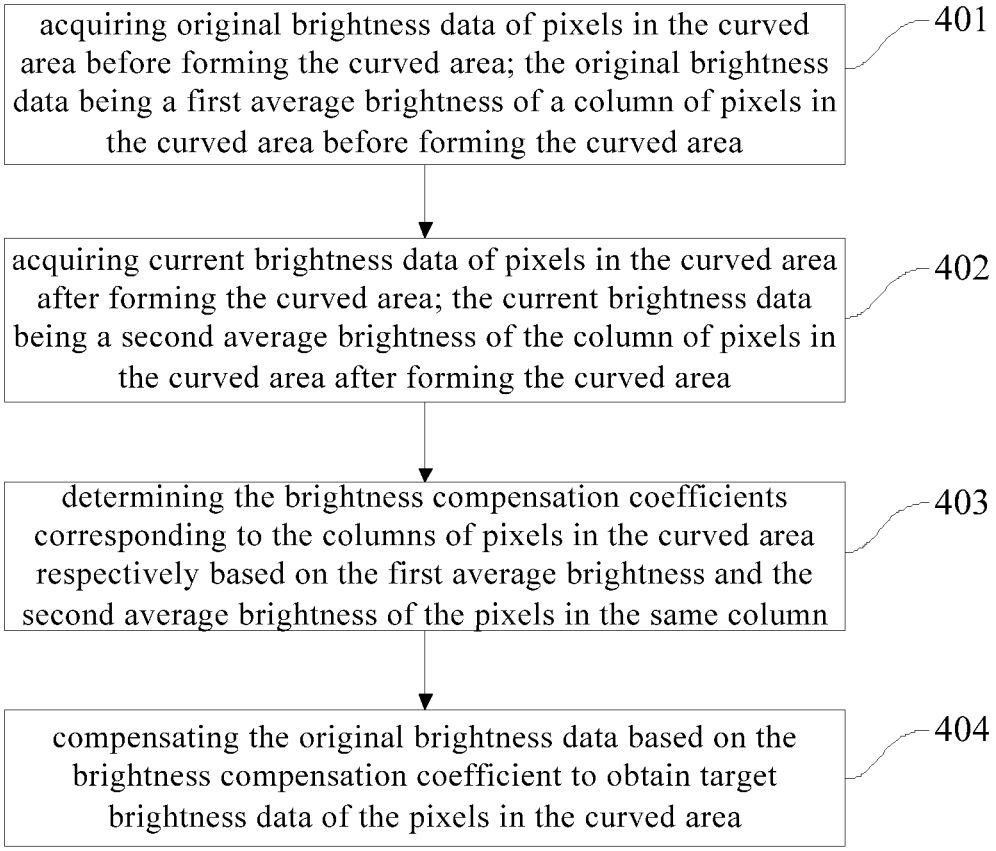
FIG. 4 shows a flowchart of a brightness compensation method according to another exemplary embodiment.

Referring to FIG. 4, a flowchart of a brightness compensation method for a curved display panel according to another exemplary embodiment is shown. The brightness compensation method may include the following steps.

Step 401: acquiring original brightness data of pixels in the curved area before forming the curved area; the original brightness data being a first average brightness of a column of pixels in the curved area before forming the curved area.

In the exemplary embodiment, for a flat display panel without attaching a cover plate, a first average brightness $L_{p_avg}(x)$ of each column of pixels is acquired.

For each column of pixels in the first curved area, $1\leq x\leq x_1$, the first average brightness $L_{p_avg}(x)=g_1(x)$. For each column of pixels in the flat area, $x_1<x<x_2$, the first average brightness $L_{p_avg}(x)=a$. For each column of pixels in the second curved area, $x_2\leq x\leq w$, the first average brightness $L_{p_avg}(x)=g_2(x)$.

It should be noted that the first average brightness refers to the average brightness of all pixels in one column in a flat display panel without attaching a cover plate. For example, the first average brightness of pixels in the second column is the average brightness of all pixels in the second column.

In some exemplary embodiments, before step 401 is performed, demura compensation is performed on the pixels in the flat display panel.

First, demura compensation is performed on all pixels in the flat display panel without attaching a cover plate, so that the flat display panel has high uniformity, and then the first average brightness of each column of pixels in the flat display panel is acquired after the demura compensation.

Step 402: acquiring current brightness data of pixels in the curved area after forming the curved area; the current brightness data being a second average brightness of the column of pixels in the curved area after forming the curved area.

In some exemplary embodiments, the flat display panel is attached to a cover plate and subjected to a bending process to obtain the curved display panel, and the second average brightness $L_{cover_avg}(x)$ of each column of pixels in the curved display panel is acquired.

For each column of pixels in the first curved area, $1\leq x\leq x_1$, the second average brightness $L_{cover_avg}(x)=h_1(x)$. For each column of pixels in the flat area, $x_1<x<x_2$; though the flat display panel is attached to the cover plate and subjected to the bending process to obtain the curved display panel, the flat area remains flat. Therefore, the same average value can be used as the second average brightness of all the columns of pixels in the flat area, that is, the second average brightness $L_{cover_avg}(x)=b$. However, since the cover plate will affect the light transmittance, the second average brightness b is smaller than the first average brightness a. For each column of pixels in the second curved area, $x_2\leq x\leq w$, the second average brightness $L_{cover_avg}(x)=h_2(x)$.

It should be noted that the second average brightness refers to the average brightness of all pixels in one column of the curved display panel.

The curved display panel is obtained by attaching a cover plate to the flat display panel and performing a bending process on the flat display panel.

Step 403, determining the brightness compensation coefficients corresponding to the columns of pixels in the curved area respectively based on the first average brightness and the second average brightness of the pixels in the same column.

In some exemplary embodiments, based on the first average brightness and the second average brightness of the pixels in the same column, the brightness compensation coefficients c(x) corresponding to the columns of pixels in the curved area of the curved display panel are respectively calculated.

For example, the curved area includes the pixels from the first column to the tenth column. The brightness compensation coefficient of the pixels in the first column is calculated based on the first average brightness of the pixels in the first column and the second average brightness of the pixels in the first column. The brightness compensation coefficient of the pixels in the second column is calculated based on the first average brightness of the pixels in the second column and the second average brightness of the pixels in the second column, and so on, until the brightness compensation coefficient of the pixels in the tenth column is calculated.

In another exemplary embodiment, only the brightness of the pixels in the curved area needs to be compensated, the first average brightness of each column of pixels in the area of the flat display panel (to be bent into the curved area) is acquired in step 401, and the second average brightness of each column of pixels in the curved area of the curved display panel is acquired in step 402, then the brightness compensation coefficients corresponding to the columns of pixels in the curved area of the curved display panel are respectively calculated based on the first average brightness and the second average brightness of the pixels in the same column.

Specifically, the ratio of the first average brightness to the second average brightness of pixels in the same column of the curved area is multiplied by a designated coefficient to obtain a brightness compensation coefficient corresponding to each column of pixels in the curved area.

For a curved area of a curved display panel, the brightness compensation coefficient corresponding to pixels in the x-th column $c(x)=M(x)\times L_{p_avg}(x)/L_{cover_avg}(x)$, where M(x) is the designated coefficient corresponding to the pixels in the x-th column.

Since the thickness of the cover plate corresponding to the curved area is different from the thickness of the cover plate corresponding to the flat area, and the cover plate will affect the light transmittance, $L_{p_avg}(x)\times M(x)=L_{cover_avg}(x)\times c(x)$, both sides of the equation are the brightness after the cover plate is attached to the flat display panel, then it can be inferred that $c(x)=M(x)\times L_{p_avg}(x)/L_{cover_avg}(x)$.

Specifically, the designated coefficient M(x) is a transmittance of the cover plate corresponding to a column of pixels. For the designated coefficient corresponding to the pixels in the x-th column, M(x) specifically refers to the transmittance of the cover plate corresponding to the pixels in the x-th column. For the flat area, the thickness and transmittance of the cover plate are constant, that is, when $x_1<x<x_2$, M(x)=Mp. For the curved area, the thickness of the cover plate corresponding to the columns of pixels varies, and the transmittance also varies. The transmittance at the x-th column of pixels is unified to a constant M(x). When the curved display panel includes a first curved area, each column of pixels in the first curved area has a corresponding brightness compensation coefficient $c_1(x)=M(x)\times L_{p_avg}(x)/L_{cover_avg}(x)=M(x)\times g_1(x)/h_1(x)$. When the curved display panel includes a second curved area, each column of pixels in the second curved area has a corresponding brightness compensation coefficient $c_2(x)=M(x)\times L_{p_avg}(x)/L_{cover_avg}(x)=M(x)\times g_2(x)/h_2(x)$. When the curved display panel includes a first curved area and a second curved area, each column of pixels in the first curved area has a corresponding brightness compensation coefficient $c_1(x)=M(x)\times g_1(x)/h_1(x)$, and each column of pixels in the second curved area has a corresponding brightness compensation coefficient $c_2(x)=M(x)\times g_2(x)/h_2(x)$.

In some exemplary embodiments, the curved display panel further includes a flat area, and the designated coefficient M(x) of the flat area is a ratio of a third average brightness of the pixels in the flat area to a fourth average brightness of the pixels in the flat area. The third average brightness is an average value of the second average brightness of the columns of pixels in the flat area of the curved display panel, and the fourth average brightness is an average value of the first average brightness of the columns of pixels in the flat area of the curved display panel.

For the flat display panel before attaching the cover plate and performing the bending process, since the first average brightness of each column of pixels in the flat area of the flat display panel is a, the fourth average brightness obtained by averaging the first average brightness a of the columns of pixels is also a. Correspondingly, for the curved display panel obtained by attaching the cover plate and performing the bending process, the second average brightness of each column of pixels in the flat area is b, and the third average brightness obtained by averaging the second average brightness b of the columns of pixels is also b.

The designated coefficient M(x) of the flat area may be a ratio of the third average brightness b of the pixels in the flat area to the fourth average brightness a of the pixels in the flat area, that is, M(x)=Mp=b/a. The designated coefficient M(x) of the curved area can be calculated based on the designated coefficient of the flat area Mp and the optical structure of the cover plate.

Step 404: compensating the original brightness data based on the brightness compensation coefficient to obtain target brightness data of the pixels in the curved area.

The principle of this step is similar to the principle of step 103 in the exemplary embodiment shown in FIG. 1, and details are not described herein again.

In some exemplary embodiments, based on the first average brightness of each column of pixels in the flat display panel and the second average brightness of each column of pixels in the curved display panel, a brightness compensation coefficient corresponding to each column of pixels in the curved area is calculated. The original brightness data of the pixels in the curved area is acquired. The target brightness data of the pixels in the curved area is obtained by compensating the original brightness data based on the brightness compensation coefficient. The brightness compensation coefficient is used to correct the brightness attenuation of the curved area after forming the curved area. The original brightness data of the pixels in the curved area are compensated to the target brightness data in the front observation state, which reduces the excessive compensation for the curved area in the demura compensation operation.

Figure 5:
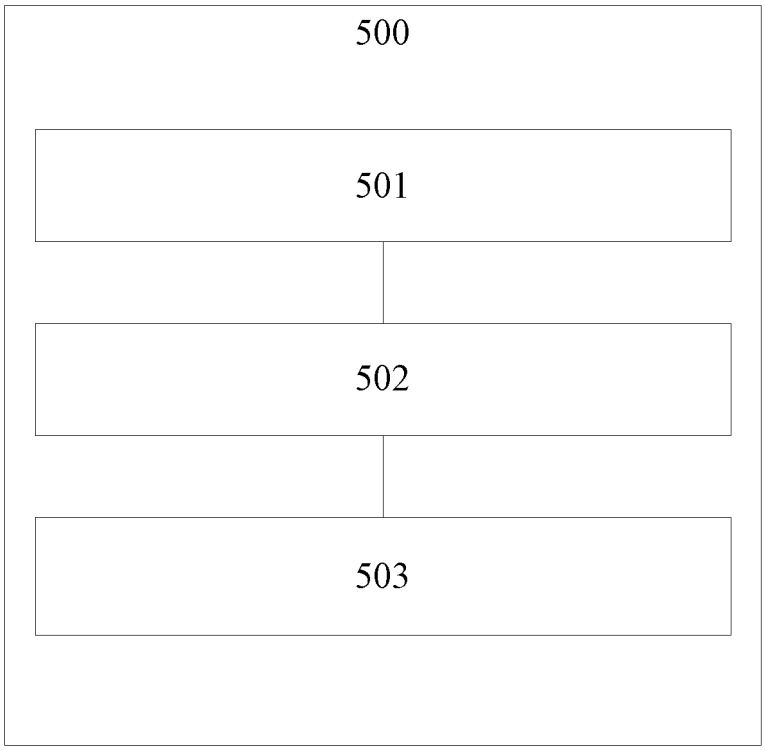
FIG. 5 shows a structural block diagram of a brightness compensation device according to an exemplary embodiment.

Referring to FIG. 5, a structural block diagram of a brightness compensation device 500 according to an embodiment of the present disclosure is shown. The brightness compensation device 500 is applied to a curved display panel having a curved area.

The brightness compensation device 500 according to some exemplary embodiments includes an acquisition circuit 501, a determining circuit 502, and a compensation circuit 503.

The acquisition circuit 501 is configured to acquire original brightness data of pixels in the curved area before forming the curved area, and acquire current brightness data of the pixels in the curved area after forming the curved area.

The determining circuit 502 is configured to determine a brightness compensation coefficient of the pixels in the curved area based on the original brightness data and the current brightness data.

The compensation circuit 503 is configured to compensate the original brightness data based on the brightness compensation coefficient to obtain target brightness data of the pixels in the curved area.

Figure 6:
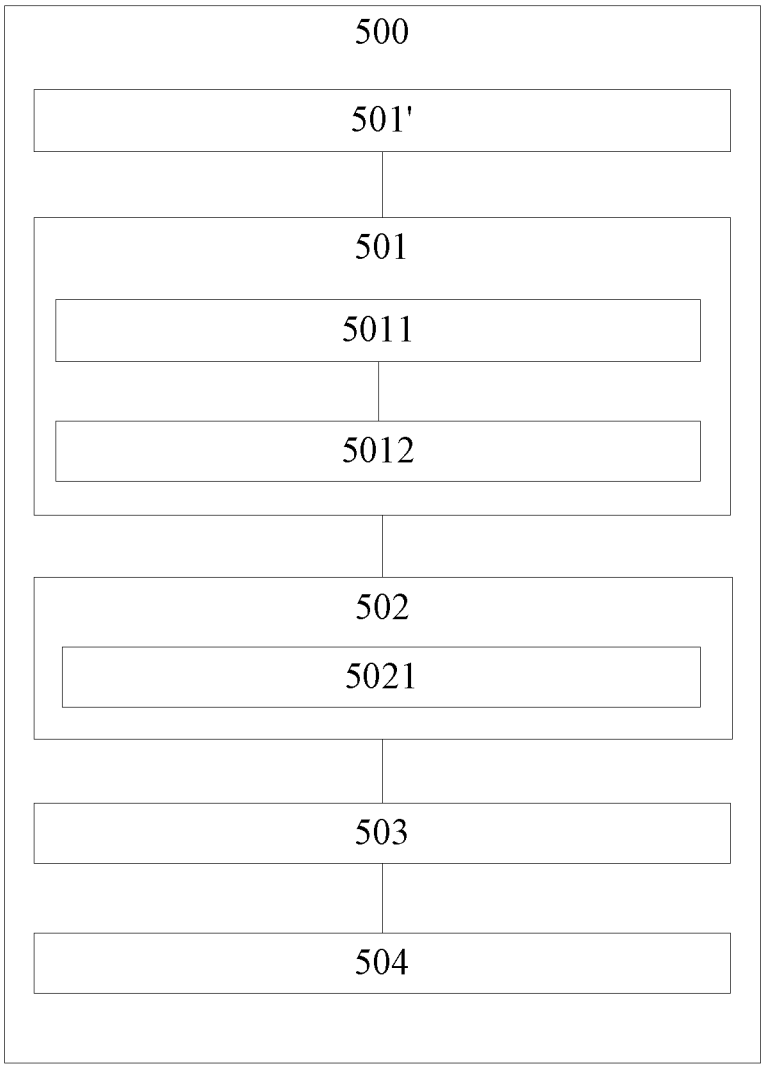
FIG. 6 shows a structural block diagram of a brightness compensation device according to another exemplary embodiment.

Referring to FIG. 6, a structural block diagram of a brightness compensation device 500 according to another exemplary embodiment is shown.

In some exemplary embodiments, the acquisition circuit 501 may include a first average brightness acquiring sub-circuit 5011 and a second average brightness acquiring sub-circuit 5012.

The first average brightness acquiring sub-circuit 5011 is configured to acquire a first average brightness of a column of pixels in the curved area before forming the curved area. The second average brightness acquiring sub-circuit 5012 is configured to acquire a second average brightness of the column of pixels in the curved area after forming the curved area. The curved display panel is obtained by attaching a cover plate to a flat display panel and performing a bending process on the flat display panel.

In some exemplary embodiments, the determining circuit 502 includes a brightness compensation coefficient calculation unit 5021 configured to multiply a ratio of the first average brightness to the second average brightness by a transmittance of the cover plate corresponding to the column of pixels, thereby obtaining the brightness compensation coefficient of the column of pixels.

In some exemplary embodiments, the brightness compensation device 500 further includes a demura compensation circuit 501' configured to perform demura compensation on pixels in the flat display panel.

In some exemplary embodiments, the brightness compensation device 500 further includes a driving chip 504 configured to drive the curved display panel and store the brightness compensation coefficient.

In some exemplary embodiments, the brightness compensation coefficient of the pixels in the curved area is determined based on the brightness of the pixels in the curved display panel before forming the curved area and the brightness of the pixels after forming the curved area. The original brightness data of the pixels in the curved area is acquired. The target brightness data of the pixels in the curved area is obtained by compensating the original brightness data based on the brightness compensation coefficient. The brightness compensation coefficient is used to correct the brightness attenuation of the curved area after forming the curved area. The original brightness data of the pixels in the curved area are compensated to the target brightness data in the front observation state, which reduces the excessive compensation for the curved area in the demura compensation operation.

In the context of the disclosure, each "unit" and "circuit" in the exemplary embodiments can be realized by a computer or a combination of a computer and a suitable sensor; the processing of each "unit" and "circuit" can be realized e.g. by a processor in the computer.

For the foregoing method exemplary embodiments, for simplicity of description, they are all described as a series of action combinations, but those skilled in the art should know that the present disclosure is not limited by the described order of actions, because according to this disclosure, some steps can be performed in another order or simultaneously. Moreover, those skilled in the art should also know that the exemplary embodiments described in the specification are all optional embodiments, and the actions and circuits involved are not necessarily required by the present disclosure.

Each exemplary embodiment in this detailed description is described in a progressive manner. Each exemplary embodiment focuses on the differences from other exemplary embodiments, and the same or similar parts between the various embodiments may refer to each other.

Finally, it is to be noted that relational terms such as first and second are solely used herein to distinguish one entity or operation from another without necessarily requiring or implying any actual such relationship or order between these such entities or operations. Moreover, the terms "comprise", "include" or any other variation thereof is intended to encompass non-exclusive inclusion such that a process, method, article or device that includes a series of elements includes not only those elements but also other elements not explicitly listed, or also includes elements inherent to such process, method, article or device. Without further limitation, elements defined by the phrase "comprising one . . . " do not preclude the presence of additional identical elements in a process, method, article, or device that includes said elements.

The above exemplary embodiments are only used for explanations rather than limitations to the present disclosure, the ordinary skilled person in the related technical field, in the case of not departing from the spirit and scope of the present disclosure, may also make various modifications and variations, therefore, all the equivalent solutions also belong to the scope of the present disclosure, the patent protection scope of the present disclosure should be defined by the claims.

What is claimed is:

1. A brightness compensation method for a curved display panel having a curved area, comprising:

acquiring original brightness data of pixels in the curved area before forming the curved area;

acquiring current brightness data of the pixels in the curved area after forming the curved area;

determining a brightness compensation coefficient of the pixels in the curved area based on the original brightness data and the current brightness data; and compensating the original brightness data based on the brightness compensation coefficient to obtain target brightness data of the pixels in the curved area;

wherein the original brightness data is a first average brightness of a column of pixels in the curved area before forming the curved area; the current brightness data is a second average brightness of the column of pixels in the curved area after forming the curved area;

wherein the curved display panel is obtained by attaching a cover plate to a flat display panel and performing a bending process on the flat display panel; and wherein determining the brightness compensation coefficient of the pixels in the curved area based on the original brightness data and the current brightness data comprises, multiplying a ratio of the first average brightness to the second average brightness by a transmittance of the cover plate corresponding to the column of pixels, thereby obtaining the brightness compensation coefficient of the column of pixels.

2. The method according to claim 1, wherein prior to acquiring the original brightness data of the pixels in the curved area before forming the curved area, the method further comprises:

performing demura compensation on pixels in the flat display panel.

3. The method according to claim 1, further comprising: storing the brightness compensation coefficient in a driving chip of the curved display panel.

4. The method according to claim 1, further comprising: storing the brightness compensation coefficient in a driving chip of the curved display panel.

5. A brightness compensation device for a curved display panel having a curved area, comprising:

an acquisition circuit configured to acquire original brightness data of pixels in the curved area before forming the curved area, and acquire current brightness data of the pixels in the curved area after forming the curved area;

a determining circuit configured to determine a brightness compensation coefficient of the pixels in the curved area based on the original brightness data and the current brightness data; and a compensation circuit configured to compensate the original brightness data based on the brightness compensation coefficient to obtain target brightness data of the pixels in the curved area;

wherein the acquisition circuit comprises: a first average brightness acquiring sub-circuit configured to acquire a first average brightness of a column of pixels in the curved area before forming the curved area; and a second average brightness acquiring sub-circuit configured to acquire a second average brightness of the column of pixels in the curved area after forming the curved area;

wherein the curved display panel is obtained by attaching a cover plate to a flat display panel and performing a bending process on the flat display panel; and wherein the determining circuit comprises: a brightness compensation coefficient calculation unit configured to multiply a ratio of the first average brightness to the second average brightness by a transmittance of the cover plate corresponding to the column of pixels, thereby obtaining the brightness compensation coefficient of the column of pixels.

6. The brightness compensation device according to claim 5, further comprising:

a demura compensation circuit configured to perform demura compensation on pixels in the flat display panel.

7. The brightness compensation device according to claim 5, further comprising:

a driving chip configured to drive the curved display panel and store the brightness compensation coefficient.

8. The brightness compensation device according to claim 5, further comprising:

a driving chip configured to drive the curved display panel and store the brightness compensation coefficient.

* * * * *